United States Patent [19]

Griffith

[11] Patent Number: 4,733,700

[45] Date of Patent: Mar. 29, 1988

[54] WOVEN FABRIC

[75] Inventor: John D. Griffith, Boldon, England

[73] Assignee: Bonas Machine Company Limited, Sunderland, England

[21] Appl. No.: 924,181

[22] Filed: Oct. 23, 1986

Related U.S. Application Data

[63] Continuation of Ser. No. 600,952, Apr. 16, 1984.

[30] Foreign Application Priority Data

Apr. 20, 1983 [GB] United Kingdom ..... 8310710

[51] Int. Cl.[4] ..... D03D 5/00

[52] U.S. Cl. ..... 139/383 R; 139/432

[58] Field of Search ..... 139/431, 432, 383 R, 139/437

[56] References Cited

U.S. PATENT DOCUMENTS

| | | | |
|---|---|---|---|
| 805,751 | 11/1905 | Renger | 139/437 |
| 4,174,738 | 11/1979 | Berger et al. | 139/432 |
| 4,344,463 | 8/1982 | Muller et al. | 139/383 R |
| 4,421,142 | 12/1983 | Muller | 139/383 R |

*Primary Examiner*—Henry S. Jaudon

*Attorney, Agent, or Firm*—Dann, Dorfman, Herrell & Skillman

[57] ABSTRACT

A woven fabric which has been woven on a needle loom wherein the weft loops are secured by a knitted thread construction, the secured weft loops being located in board of the warp thread defining the opposite edge of the fabric to the edge whereat weft insertion has taken place and the knitted thread construction being woven between warp threads positioned adjacent opposite said edge.

5 Claims, 8 Drawing Figures

Prior art

Prior art

WOVEN FABRIC

This application is a continuation of application Ser. No. 600,952, filed 4/16/84.

The present invention relates to a woven fabric produced on a needle or rapier weaving loom, a method of weaving the fabric and a loom for weaving the fabric.

When weaving fabric on a needle loom the weft yarn is always inserted from one side of the fabric by a needle or rapier and the weft yarn has to be secured at the opposite side before the needle retracts. After retraction the warp yarns are moved to create a new shed pattern thereby trapping the weft yarn therebetween.

In the accompanying drawings, FIGS. 1 to 4 illustrate four different conventional methods for securing the weft yarn.

In FIG. 1 a latch needle (not shown) is used to knit loops 12 of weft yarn 11 to one another. Although this method is simple it necessarily creates a bulky edge or selvedge and in some cases, if this edge is cut or damaged unravelling of the weft yarn can result.

In FIG. 2 a catch thread 15 which is separate to the weft yarn 11 is knit so as to form a chain stitch which passes through the loops 12. This method creates a neater edge or selvedge but is even easier to unravel.

In FIG. 3 an additional thread 16 is knitted in with the catch thread 15 in order to restrain unravelling. Thread 16 is usually referred to as a lock thread. Although the lock thread 16 makes unravelling more difficult it necessarily makes the edge or selvedge bulky.

In FIG. 4, a lock thread 16 is knitted with loops 12 to provide an edge which is resistant to unravelling. Unfortunately, such an edge or selvedge also is necessarily bulky.

Apart from the methods illustrated above there are other methods used which are variations of these methods. For example two catch threads may be knitted in the manner illustrated in FIG. 2 but they pass through different loops 12 so that if one catch thread is broken unravelling of the edge of the fabric is still restrained by the other catch thread.

It is a general aim of the present invention to secure the loops 12 of weft yarn in a manner which restrains unravelling without creating a bulky edge.

According to one aspect of the present invention there is provided a woven fabric which has been woven on a needle loom wherein the weft loops are secured by a knitted catch thread construction, the secured weft loops being located inboard of the warp thread defining the opposite edge of the fabric to the edge whereat weft insertion has taken place, i.e. the weft yarn insertion edge, and the knitted thread construction being woven between warp threads positioned adjacent said opposite edge. The knitted thread construction may comprise a single thread or several threads which are knitted together to define a string of knitted stitches which is resistant to unravelling. More than one knitted thread construction may be provided, each thread construction being arranged to secure selected loops of weft yarn. Preferably, the denier of the or each knitted thread construction is chosen to be approximately the same as the denier of the weft yarn. This ensures that the string of knitted stiches has a size approximating the size of the weft yarn, and that the two edges or selvedges of the fabric are visually similar.

According to another aspect of the present invention there is provided a method of weaving fabric on a needle or rapier loom including producing a knitted catch thread construction at the opposite side of the warp sheet to the side at which the weft yarn is inserted, the thread construction being knitted so as to catch the weft yarn as it protrudes beyond said opposite side and being knitted at a sufficiently fast rate so as to be pulled inboard of said opposite edge before beat up.

Various aspects of the present invention are hereinafter described with reference to the following accompanying drawings, in which.

Figure 5:
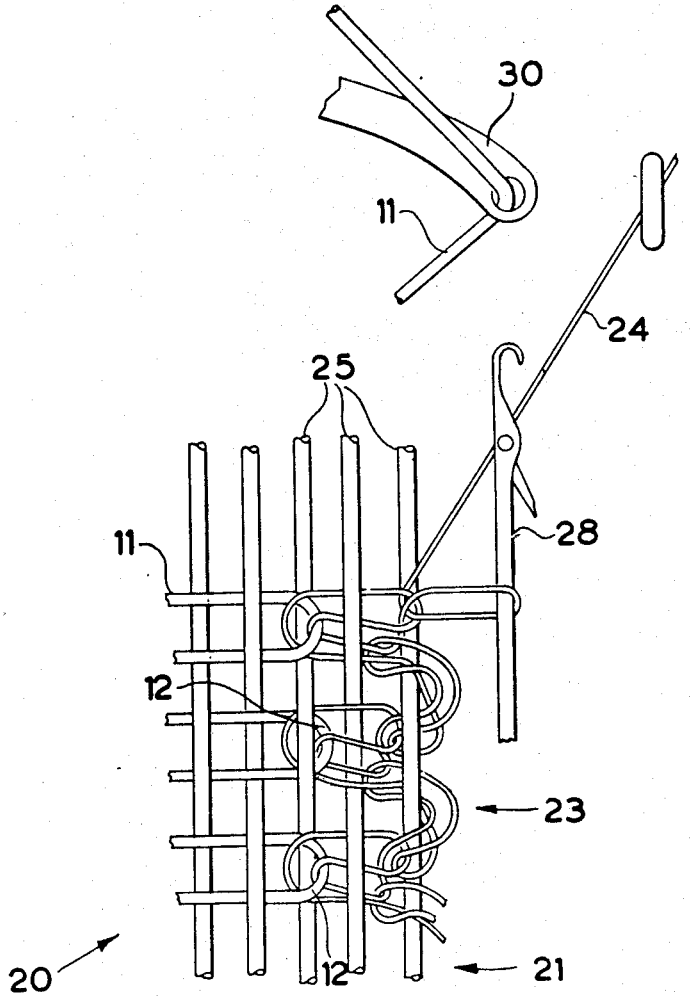
FIG. 5 is a schematic illustration of fabric according to the present invention being shown during weaving.
Figure 6:
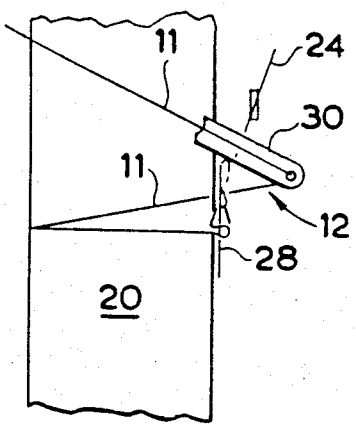

Referring initially to FIG. 5 there is shown a portion of fabric 20 which is located adjacent to the fabric edge 21 which is opposite to the fabric edge (not shown in FIG. 5) at which insertion of the weft yarn 11 takes place. As seen a knitted catch thread construction 23 in the form of a string of knitted stitches extends in a sinusoidal manner in the warp direction to interconnect with loops 12 of the weft yarn 11. As illustrated the thread construction is wrapped about the outermost warp thread 25 and extends from fabric edge 21 across three warp threads 25 and is woven therebetween. In the preferred embodiment shown in FIG. 5, the catch thread construction 23 comprises a string of knitted stitches interlaced with the weft yarn loops 12 and woven in a plain weave with the three warp threads or yarns 25 located closest to fabric edge 21, the string of knitted stitches 23 being interlaced in alternating fashion with the warp threads in the same manner as the respective weft yarn loops 12 which they secure or anchor in the fabric 20. In FIG. 6, the thread construction 23 is created by knitting a chain stitch from a single catch thread 24 by means of a reciprocating latch needle 28 in a manner to be described hereinafter. Preferably the denier of the thread 24 is chosen so that after knitting, the thread construction 23 is of similar size to the weft yarn 11.

Accordingly, a neat fabric edge or selvedge is created at said opposite edge 21 which is equivalent to the selvedge at the edge at which weft insertion takes place and similar in appearance thereto. Additionally since the thread construction 23 is woven between the warp threads 25 the thread 24 is trapped thereby and so discourages unravelling of itself and the weft yarn.

Figure 9:
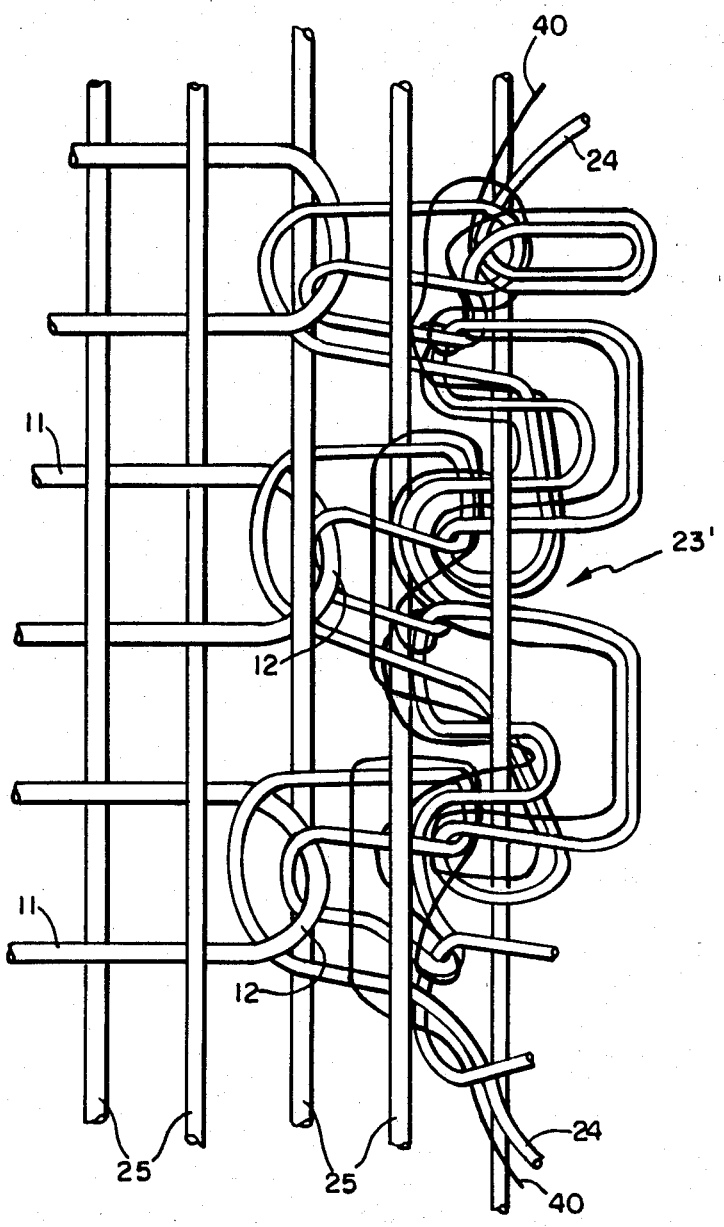
FIGS. 9 and 10 are schematic illustrations each depicting modifications of the fabric according to this invention.
Figure 10:
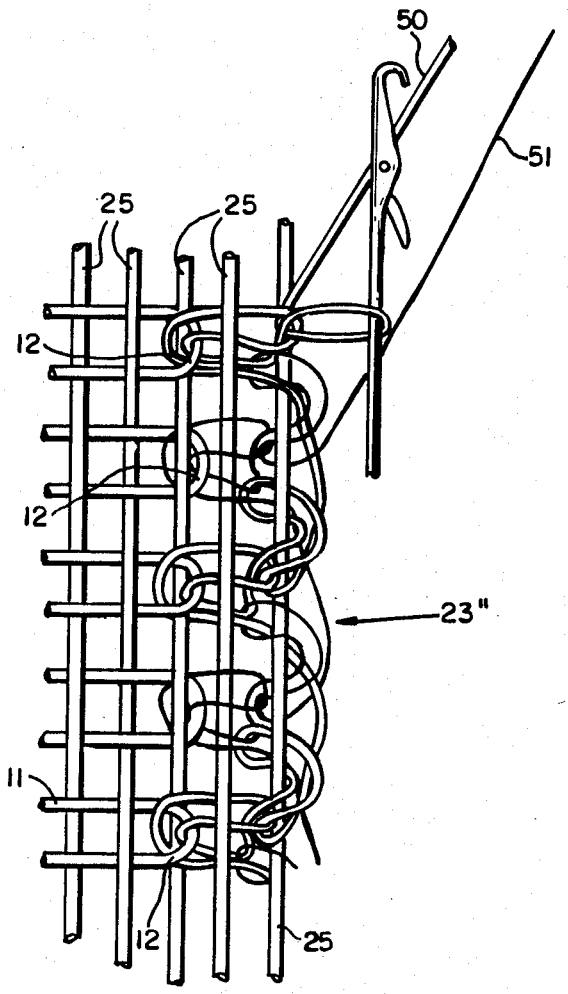

It is envisaged, however that catch thread 24 may require some additional locking. Accordingly the thread construction 23 may comprise two or more threads which may be knitted to form a string of stitches resistant to unravelling. This could be achieved for example by either (FIG. 9) using an additional locking thread (analogous to that shown in FIG. 3) which would lock some or all of the catch thread stitches or (FIG. 10) using two catch threads to perform the function of thread 24. These could be used to form stitches alternately or in any other combination. FIG. 9 depicts a string of knitted stitches 23' composed of the catch thread 24 and a lock thread 40 interwoven with the warp thread 25. FIG. 10 depicts a string of knitted stitches 23'' comprising two catch threads 50 and 51 interwoven with the warp thread 25. In FIG. 10, the knitted stiches formed of catch yarn 50 secure alternative weft yarn loops 12, while the knitted stitches formed of the second catch yarn 51 secure the intervening weft yarn loops 12.

Figure 8:
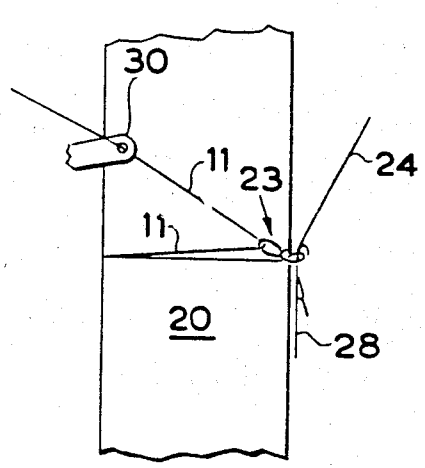
FIGS. 6 to 8 are schematic illustrations showing a sequence of operations in weaving in accordance with the present invention.
Figure 7:
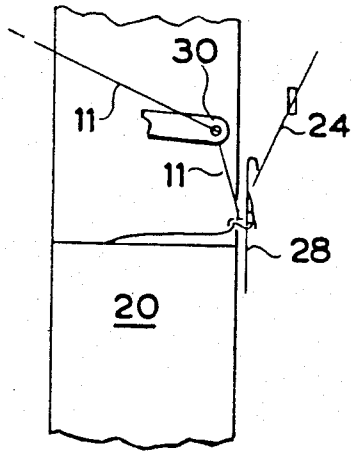

By way of illustration, a method of weaving fabric according to the present invention is represented in FIGS. 6 to 8.

In FIG. 6 the weft needle 30 has fully inserted the weft yarn 11 and is about to retract. As is conventional the latch needle 28 has advanced through the new weft yarn loop 12 formed by the needle 30 to pick up the yarn 24. The latch needle 28 retracts and the weft needle 30 begins to retract. In order to enable the loop 12 to be drawn inboard of the edge 21 of the fabric 20, the latch needle 28 knits at least one more loop before the needle 30 reaches its fully retracted position. Accordingly, for each pick (i.e. the insertion and retraction of the weft needle) the latch needle 28 knits at least twice to provide two knitted loops per each weft yarn insertion, as shown in FIG. 5. This sequence is illustrated in FIGS. 7 and 8 wherein in FIG. 7 the latch needle has advanced a second time to pick up thread 24 and in FIG. 8 the needle 28 has retracted a second time to cast off. Accordingly, if it is desired to position the weft loops 12 further inboard from the edge 21 of the fabric the latch needle is arranged to knit more stitches per pick for course adjustment and loops of a tighter or looser nature for fine adjustment.

This mode of knitting provides a further advantage in that in the conventional methods previously illustrated, the knitted loops of the catch thread and, where provided, lock thread, have to be small in order to create a neat finish. With the present method this is not necessary since the knitted loops are pulled, and thereby tightened, by the weft yarn 11 during retraction of needle 30. Accordingly problems associated with the setting of the latch needle to produce tight loops are avoided.

Figure 1:
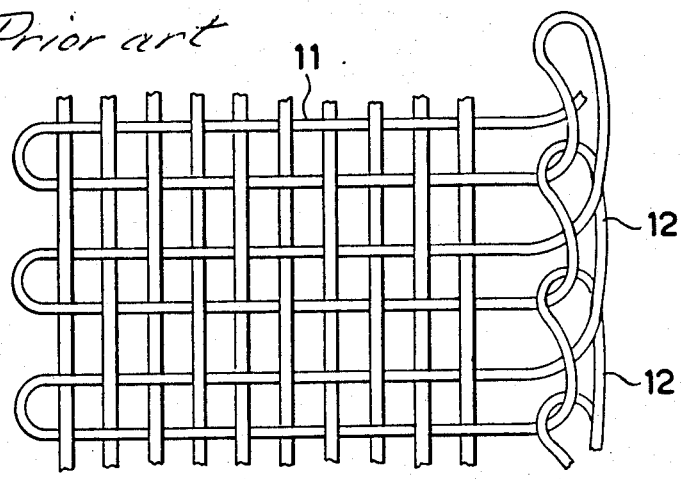
FIG. 1 Prior art
Figure 2:
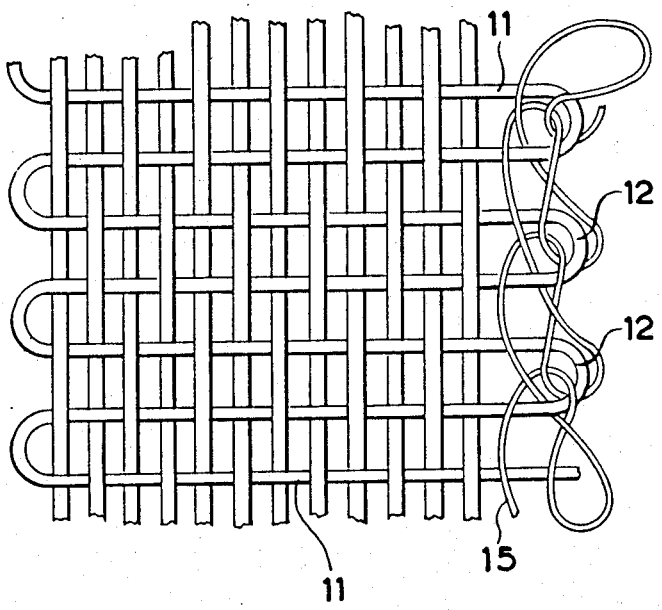
Figure 3:
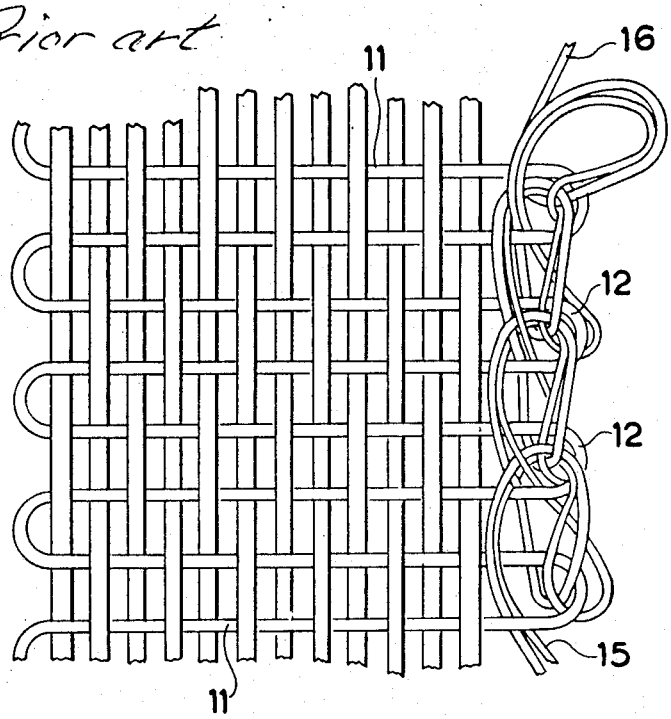
FIG. 3 Prior art
Figure 4:
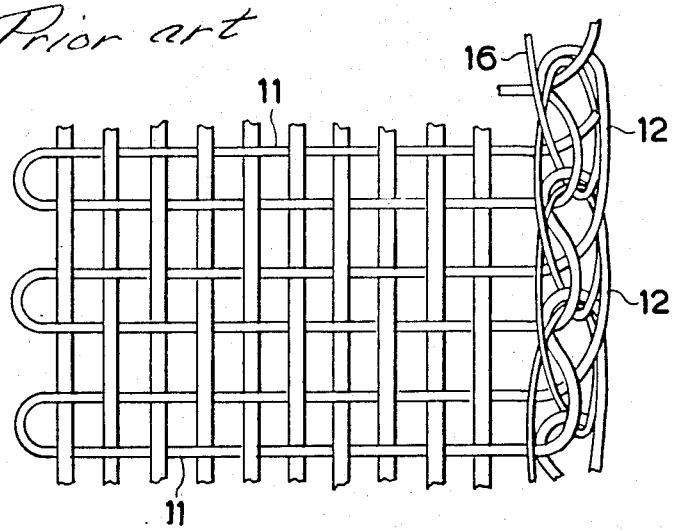

The knitting and thread control mechanisms (not shown) which actuate the reciprocal latch needle 28 and control the feed of the thread 24 thereto, respectively, are the usual mechanisms employed in needle or rapier looms to weave fabrics of the types illustrated in FIGS. 2–4 having catch and/or lock threads knitted along one edge of the fabric to provide a selvedge. In such mechanisms, the latch needles are reciprocated one stroke per weft yarn insertion by means of suitably timed rotatable cams. The catch and lock threads are fed to the needles under the control of yarn tensioning devices conventionally used in this art.

The catch thread construction 23 basically is a string of knitted stitches interlooped with the weft yarn loops 12 and woven, in a plain weave, with selected warp threads 25 adjacent fabric edge 21. The denier of the catch thread 24 is chosen so that the string of knitted stiches 23 has a size approximating the denier of the weft yarn 11. As a result, the fabric edge or selvedge 21 created by this invention visually has the same appearance as the selvedge formed at the weft yarn insertion edge of the fabric (not shown). Moreover, the fabric edge 21 of the invention functions to secure the weft yarn loops 12 in a neat and firm manner which restrains unraveling of the weft yarn 11 without creating a bulky edge or selvedge.

I claim:

1. A woven fabric which has been woven or a needle or rapier loom so as to have plural loops of weft yarn woven between plural warp yarns, the loops of weft yarn having terminal ends located inboard of the outermost warp yarn defining the edge of the fabric opposite to the fabric edge whereat weft insertion has taken place, successive weft yarn loops being secured to one another by a knitted catch thread construction comprising a string of knitted stitches knitted from at least one thread fed externally of the warp yarns and having at least two stitches per one weft loop, the knitted catch thread construction being drawn into the fabric by said weft loops so as to be woven with the warp yarns located between the terminal ends of the weft loops and said outermost warp yarn and being wrapped about said outermost warp yarn.

2. A woven fabric according to claim 1 wherein the knitted catch thread construction comprises a single thread knitted to form a string of stitches.

3. A woven fabric according to claim 1 wherein the knitted catch thread construction comprises at least two threads which are knitted together to define a string of stitches which is resistant to unravelling.

4. A woven fabric according to claim 1 wherein the knitted catch thread construction includes more than one knitted catch thread, each said catch thread being arranged to secure selected loops of weft yarn.

5. A woven fabric according to claims 1, 2, 3 or 4 wherein the denier of each knitted catch thread construction is approximately the same as the denier of the weft yarn.

* * * * *